US009134081B2

(12) United States Patent
Cusano

(10) Patent No.: US 9,134,081 B2
(45) Date of Patent: Sep. 15, 2015

(54) IMPROVISED ADJUSTABLE GUIDE ROD FOR SEMIAUTOMATIC PISTOLS

(71) Applicant: Michael Cusano, Eagle Mountain, UT (US)

(72) Inventor: Michael Cusano, Eagle Mountain, UT (US)

( * ) Notice: Subject to any disclaimer, the term of this patent is extended or adjusted under 35 U.S.C. 154(b) by 0 days.

(21) Appl. No.: 13/864,033

(22) Filed: Apr. 16, 2013

(65) Prior Publication Data

US 2014/0305016 A1 Oct. 16, 2014

(51) Int. Cl.
*F41A 3/86* (2006.01)
*F41A 3/80* (2006.01)

(52) U.S. Cl.
CPC .... *F41A 3/80* (2013.01); *F41A 3/86* (2013.01)

(58) Field of Classification Search
CPC ..... F41A 3/86; F41A 3/80; F41A 5/04
USPC ..... 42/1.06, 74, 75.03, 71.01; 89/199, 163, 89/42.01, 178, 198, 196, 147
See application file for complete search history.

(56) References Cited

U.S. PATENT DOCUMENTS 4,201,113 A * 5/1980 Seecamp ..... 89/199
4,972,760 A * 11/1990 McDonnell ..... 89/196
5,069,110 A * 12/1991 Menck ..... 89/198
5,309,815 A * 5/1994 Moller et al. ..... 89/163
6,314,859 B1 * 11/2001 Weichert et al. ..... 89/199
6,405,471 B1 * 6/2002 Mauch ..... 42/70.11
2005/0011349 A1 * 1/2005 Rohrbaugh et al. ..... 89/147
2008/0196289 A1 * 8/2008 Mantas ..... 42/1.06

OTHER PUBLICATIONS http://www.taurusarmed.net/forums/smithing/72373-milpro-guide-rod-tale-lots-pics-6.html; Jul. 11, 2012.*
http://www.popularairsoft.com/news/angel-custom-rocket-recoil-spring-guide-set; Nov. 15, 2012.*

* cited by examiner

*Primary Examiner* — Samir Abdosh
*Assistant Examiner* — John D Cooper
(74) *Attorney, Agent, or Firm* — Steven Rinchert

(57) ABSTRACT

An improvised guide rod assembly for semiautomatic firearms is provided for adjusting the tensile force on a spring internal to the firearm. The assembly included a guide member distending distally from the firearm's forward components, creates a tension in the mechanical workings of the firearm during discharge, and enhances accuracy, bullet velocity, and defensive functionality. A guide rod positions inside a firearm guide channel, protruding outside the firearm from a distal end. The guide member passes through a similarly sized and dimensioned spring. Tension on the spring transfers to an adjacent firearm slide member, whereby during discharge of the firearm, the slide member meets resistance while in motion. Using the adjustable guide rod to realize spring resistance increases, the velocity of a bullet is improved as is control of the firearm after recoil. The guide rod also serves as a close proximity weapon.

10 Claims, 10 Drawing Sheets

IMPROVISED ADJUSTABLE GUIDE ROD FOR SEMIAUTOMATIC PISTOLS

FIELD OF THE INVENTION

This invention relates to guide rods for semiautomatic firearms, and more particularly relates to improvised guide rods for enhancing control, protective functionality, and the aiming functions of a firearm.

BACKGROUND

Description of the Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon.

Most modern firearms have rifled barrels to impart spin to the projectile for improved flight stability. Semiautomatic and selective fire firearms automatically cycle spent cartridges from the action of the weapon and re-chamber a fresh load from a magazine or feed until the magazine or feed is depleted. Semiautomatic firearms may incorporate closed-bolt firing mechanisms, open-bolt firing mechanisms, or other mechanisms known to those of skill in the art. In short, semiautomatic firearms automatically perform all the steps necessary to prepare the firearm for refiring after each shot, including ejecting spent casings, cocking the firing mechanism, and loading a new round into the firing chamber.

Semiautomatic handguns are often designed for use in close-quarter combat or last-resort weapon in circumstances for which bayonets of earlier centuries were designed.

Typically, semiautomatic firing mechanisms include a spring used to store mechanical energy, often in a helix coil. These springs are typically incorporated into firearm designs and disposed under the barrel, and are usually fashioned from steel. Small springs can be wound from pre-hardened stock, while larger springs are made from annealed steel and hardened after fabrication. A spring stores a force, called a spring constant, which can impart tension on an adjacently joined object, such as a slide overlaying the barrel of a firearm, which slide ejects and reloads rounds as it cycles back and forth with the recoil from discharged cartridges in accordance with the art.

Typically, the amount of tension preloaded onto a spring within semiautomatic firing mechanisms is static and not mutable by the firearm operator. Over time, the spring may fatigue reducing preloaded tension. Increased tension on the spring reduces the force with which the action slides rearward in response to recoil as well as the impact of the sliding member against a proximal end of the guide channel. Under-loaded springs may contribute to muzzle flip between rounds, reducing control and accuracy of the weapon when rapidly fired. Under-loaded springs may also cause an unnecessary reduction in the velocity of fired rounds expelled from the barrel at intended targets. Over-loaded springs may contribute to jamming of the weapon, misfiring, and failure to reload replacement cartridges from a magazine or feed. Firearm operators often chose to cycle "hotter" or "cooler" rounds through their weapons, which are rounds having more and less gun powder, thus changing the recoil force on the sliding member. Firearm operators must often switch out the spring in the firing mechanism to accommodate these changes in ammunition as there exist no means in the art of adjusting or optimizing spring tension.

In view of the foregoing, it should be clear that there is a need in the industry for an apparatus and means of adjusting the tension of the spring in typical semiautomatic firing mechanisms.

SUMMARY

From the foregoing discussion, it should be apparent that a need exists for an apparatus for adjusting the tension on the spring. Beneficially, such an apparatus would provide a plurality of features and components efficacious for helping to control the firearm by extending a guide member from the firearm, creating a tension in the mechanical workings of the firearm during discharge, and enhancing the grip on the firearm. These features create a synergy that is efficacious for enhanced manipulation and discharge of the firearm.

The present invention has been developed in response to the present state of the art, and in particular, in response to the problems and needs in the art that have not yet been fully solved by currently available apparatus. Accordingly, the present invention has been developed to provide a guide rod assembly that overcomes many or all of the above-discussed shortcomings in the art.

The guide rod assembly includes a plurality of components designed to functionally execute the necessary steps of manipulating and discharging the firearm with greater control and accuracy. These modules in the described embodiments include a plurality of components and features designed to enhance the present components of the firearm, as well as provide additional components to work in conjunction with the firearm. In some embodiments, the apparatus includes an elongate guide member that at least partially protrudes from the firearm. The guide member includes a pointed tip operable to engage an object. In this manner, the firearm can be utilized as a weapon without necessitating discharge of the firearm. Those skilled in the art, in light of the present teachings, will recognize that in a proximal confrontation, the firearm may not be operable to discharge due to restrictive movement of a firearm slide member. The protruding guide member provides sufficient force whereby space may be created for discharging the firearm. In some embodiments, the guide member adjustably extends and retracts to achieve a desired length. In yet another embodiment, a tip member attaches to the end of the guide member. For example, without limitation, a small bayonet to enhance the effectiveness of the guide member.

In one embodiment of the present invention, the apparatus generates tensions on the firearm for helping control discharge of the firearm. The guide member passes through a spring that is disposed in a lateral-restraining relationship with the guide member. The spring comprises sufficient rigidity and elasticity to generate a spring constant. The spring constant creates a tension that transfers to an adjacently engaged firearm slide member. The tension helps minimize lateral movement of the firearm slide member, thereby increasing resistance against movement by the firearm slide member. In this manner, the firearm slide member is at least partially restricted from traversing the full longitudinal span of the firearm, and the velocity of the firearm slide member during discharge is reduced. Those skilled in the art, in light of the present teachings, will recognize that restricting movement of the firearm slide member helps reduce recoil during discharge. The reduction in recoil may enhance accuracy while aiming.

The movement restrictions on the firearm slide member may also help increase the velocity of the projectile, as the tension in the slide member serves to amplify the ejection of the projectile from a firearm projectile chamber. In some embodiments, the spring constant adjusts by rotatably engaging the guide member with the spring. The spring constant may be adjustable by changing the material of the spring and by changing the pitch of the helix for the spring.

In one embodiment of the present invention, the apparatus includes a grip portion that positions on the firearm slide member. The grip portion enhances the grip of a hand while manipulating the firearm slide member. In some embodiments, the grip portion may include a strip of grip tape or a ridged surface that embeds into the hand for providing an enhanced grip. In this manner, the hand can securely grasp and pull back on the firearm slide member for manipulating the firearm, including, without limitation, recocking, cleaning, and reloading the firearm. Those skilled in the art, in light of the present teachings, will recognize that utilizing the firearm may be stressful to a user, whereby excessive sweat may be generated. Also, external elements such as rain may coat the firearm. These factors may cause the hand to slip from engagement with the firearm slide member. The grip portion positioning on the firearm slide member helps the hand enhance the manipulation of the firearm slide member, even under the wet conditions.

In operation, an elongate guide member is oriented with a proximal end pointed towards a rear end of the firearm, and a distal end pointed towards a front end of the firearm. The proximal end includes a flange. The flange is configured to abut against a guide channel proximal end. The distal end includes a threaded end configured to protrude from a guide channel distal end and threadably engage a tip member. A spring comprises a central channel configured to allow the guide member to pass through. The spring may either slide freely along a longitudinal axis of the guide member, or lock into a set position along the longitudinal axis of the guide member. The position of the spring in relation to the guide member is rotatably adjusted. The spring comprises a spring constant that creates tension upon compression or extension of the spring. Due to the adjacent positioning of the spring in relation to the firearm slide member, the tension transfers to the firearm slide member to create resistance against the sliding movement. The spring constant is adjusted by rotating the spring in relation to the guide member, utilizing different material construct, or a forming a wider or narrower helix along the spring.

The configuration of the firearm provides housing for the guide apparatus. In one embodiment comprising a semi-automatic firearm, the firearm guide channel positions adjacent to a firearm projectile chamber and a firearm slide member. The firearm slide member slides to a forward position of the firearm, thereby exposing the firearm guide channel. In this manner, the guide apparatus may at least partially position inside the firearm guide channel. A grip portion is grasped while sliding the firearm slide member. The guide apparatus is disposed to position inside the firearm guide channel with a distal end extending from an aperture in the guide channel distal end, and a proximal end abutting against a guide channel proximal end. The proximal end comprises a flange that provides a secure engagement with the guide channel proximal end. From within the firearm guide channel, the spring engages and potentially transfers tension to the firearm slide member.

The firearm slide member is then pulled back towards the rear of the firearm in preparation for discharge. During discharge of the firearm, the firearm slide member meets resistance from the spring, and thereby exhibits less lateral movement in relation to the firearm. The restricted lateral movement serves to amplify the velocity of the projectile, and also minimize recoil by the firearm. These functions improve accuracy during aiming and discharge.

The distal end of the guide member protrudes from the firearm to provide a rigid extension. The distal end may also join with a tip member, thereby potentially providing an additional weapon to the firearm. For example, without limitation, while in close confrontational engagement, a user can stab an adversary with the distal end to create sufficient space to accurately discharge the firearm, or escape without necessitating the discharge of the firearm.

In one embodiment of the present invention, the apparatus includes: an elongate guide member, the guide member being disposed to at least partially pass through a firearm guide channel, the firearm guide channel being disposed to position adjacent to a firearm projectile chamber and a firearm slide member, the guide member comprising a proximal end, the proximal end for abutting against a guide channel proximal end, the guide member further comprising a distal end, the distal end being disposed to at least partially protrude from a guide channel distal end, the distal end being configured to receive a tip member; wherein the distal end is operable to engage an object;

a spring, the spring comprising a central channel with a portion of the guide member passing through, the spring disposed in a lateral-restraining relationship with the guide member, the spring further comprising a spring constant, the spring being operable to rotatably engage the guide member for adjusting the spring constant, the spring constant being operable to transfer a tension to the slide member, the tension being operable to help minimize lateral movement of the firearm slide member;

whereby a velocity of a projectile discharged from the firearm projectile chamber is at least partially increased;

whereby a recoil of the firearm during discharge of the projectile is at least partially minimized; and a grip portion, the grip portion being disposed to position on the firearm slide member, the grip portion being configured to be operable to enhance the grip of a hand while manipulating the firearm slide member.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

The depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method.

Figure 1:
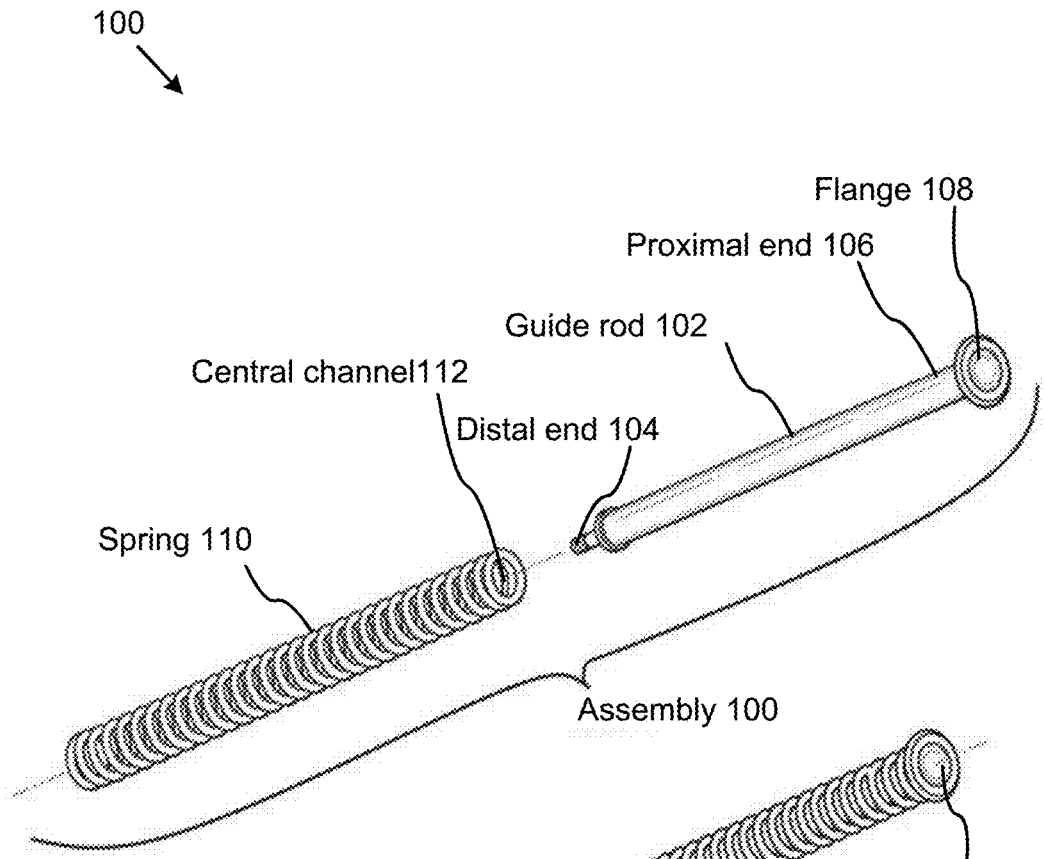
FIG. 1 is a detailed perspective view illustrating an exemplary guide apparatus, where an exemplary guide member is disengaged from an exemplary spring, in accordance with the present invention.
Figure 2:
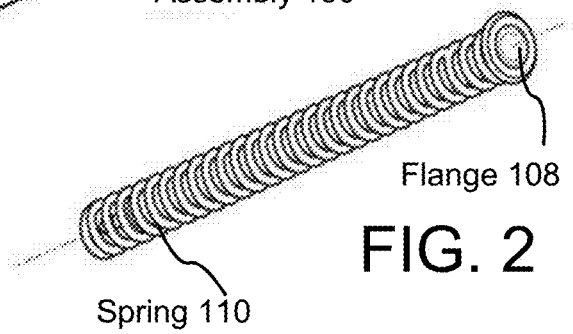
FIG. 2 is a detailed perspective view illustrating an exemplary guide apparatus, where an exemplary guide member is engaged with an exemplary spring, in accordance with the present invention.
Figure 3:
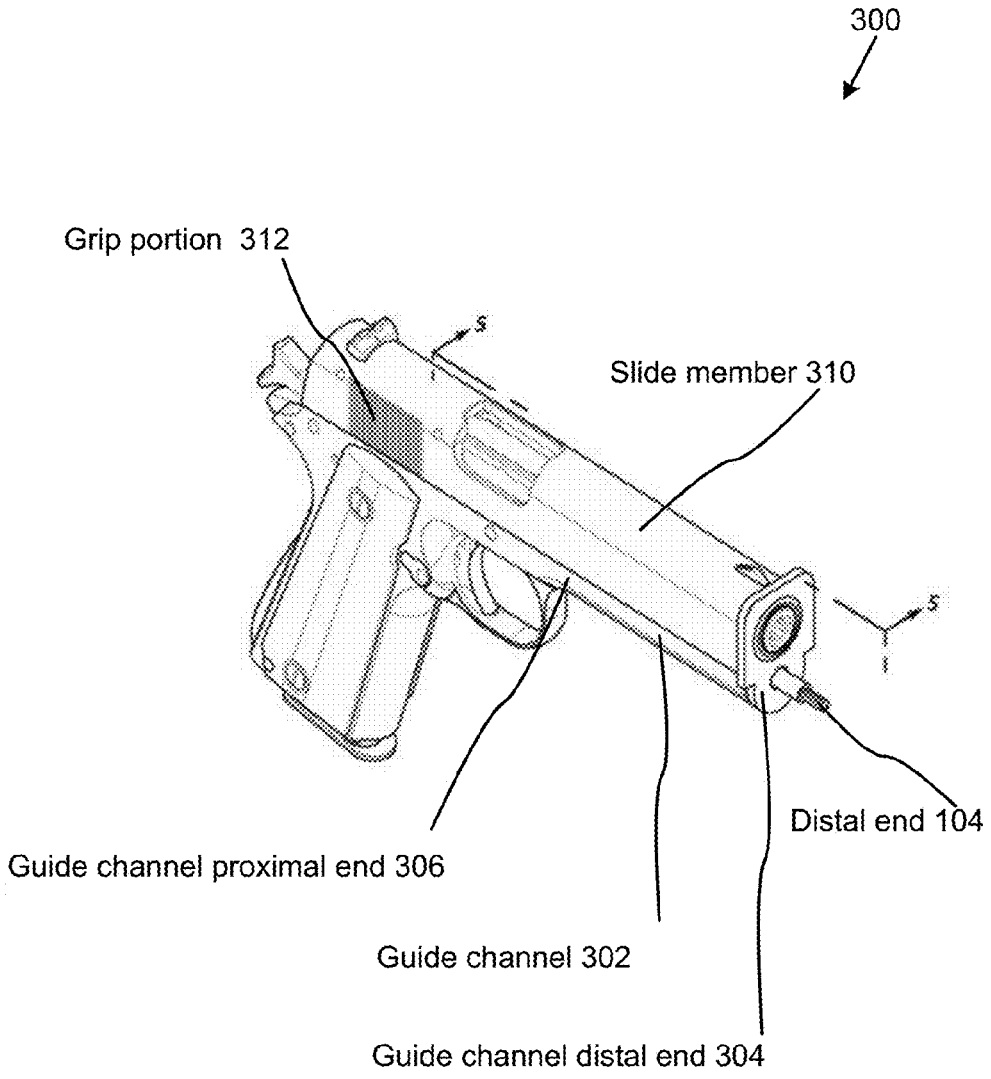
FIG. 3 is a detailed perspective view illustrating an exemplary guide apparatus positioned inside an exemplary firearm, in accordance with the present invention.

FIGS. 1, 2 and 3 are detailed perspective views illustrating an exemplary guide apparatus 100 and an exemplary firearm 300, where an exemplary guide member 102 is disengaged and engaged from an exemplary spring 110, in accordance with the present invention. In the present invention, a guide apparatus 100 includes an elongated guide member 102 that at least partially protrudes from a firearm 300 forward of the distal end of the barrel or projection chamber 308. Suitable materials for the guide member 102 may include, without limitations, polymers, high density polymers, polyvinyl chloride, steel, aluminum, iron, titanium, wood, and alloys. In some embodiments, the guide member 102 is disposed to position in a firearm guide channel 302. The firearm guide channel 302 positions adjacent to a firearm projectile chamber 308 and a firearm slide member 310. In one embodiment, the firearm guide channel 302 positions beneath, and adjacent to a firearm slide member 310. The guide member 102 includes a distal end 104 that extends from the firearm 300 through a guide channel distal end 304. The distal end 104 may include a threaded rod. The distal end 104 is operable to engage an object 1000. In this manner, the firearm 300 can be utilized as a weapon without necessitating discharge of the firearm 300. Those skilled in the art, in light of the present teachings, will recognize that in a proximal confrontation, the firearm 300 may not be operable to discharge due to restrictive movement of a firearm slide member. The protruding guide member 102 provides sufficient force whereby space may be created for discharging the firearm 300. In some embodiments, the guide member 102 adjustably extends and retracts to achieve a desired length. In yet another embodiment, a tip member, such as a bayonetted device, may attach to the distal end 104 of the guide member 102.

The spring 110 may be captured or uncaptured on the guide member 102.

In one embodiment of the present invention, the apparatus 100 comprises a proximal end 106 that orients towards a rearward end of the firearm 300. The proximal end 106 includes a flange 108 (or annularity) that abuts against a guide channel proximal end 306 to form a lateral base. However, in one alternative embodiment, the proximal end 106 may join with the guide channel proximal end 306 through other mechanisms, including, without limitation, welding, drilling, and forming an integral unit with the firearm guide channel 302. It other embodiments, the proximal end 106 is detachably affixed in place. In this manner, during discharge, the firearm guide channel 302 retains a stationary position in relation to the firearm slide member 310. Further, the firearm guide channel 302 moves in a generally opposite direction of the firearm slide member 310 during discharge, thereby serving to transfer tension from the guide apparatus 100 to the firearm slide member 310.

In one embodiment of the present invention, the guide member 102 comprises a spring 110 that joins with the guide member 102. The spring 110 is operable to store mechanical energy and release the energy as a tension that forms a resistance against the firearm slide member 310. The guide member 102 passes through a central channel 112 of the spring 110. The spring 110 is disposed in a lateral-restraining relationship with the guide member 102. In some embodiments, the central channel 112 may form a snug fit with the guide member 102. However, in other embodiments, the central channel 112 may loosely encapsulate the guide member 102. The spring 110 comprises sufficient rigidity and elasticity to generate a spring constant 502. The spring constant 502 creates a tension that transfers to the firearm slide member 310. The tension helps minimize lateral movement of the firearm slide member 310, thereby increasing resistance against movement by the firearm slide member 310. For example, without limitation, the firearm slide member 310 is at least partially restricted from traversing the full longitudinal span of the firearm 300, and the velocity of the firearm slide member 310 during discharge is reduced. Those skilled in the art, in light of the present teachings, will recognize that restricting movement of the firearm slide member 310 helps reduce recoil during discharge. The reduction in recoil enhances accuracy while aiming. The movement restrictions on the firearm slide member 310 also help increase the velocity of the projectile, as the tension in the firearm slide member 310 serves to amplify the ejection of the projectile from a firearm projectile chamber 308. In some embodiments, the spring constant 502 adjusts by rotatably engaging the guide member 102 with the spring 110. The spring constant 502 may be adjustable by changing the material of the spring 110 and by changing the pitch of the helix of the spring 110.

In one embodiment of the present invention, the apparatus 100 includes a grip portion 312 that positions on the firearm slide member 310. The grip portion 312 enhances the grip of a hand while manipulating the firearm slide member 310. However, in other embodiments, the grip portion 312 may also position on the barrel of a rifle or the handle of a pistol, whereby control of the firearm 300 is further enhanced. In some embodiments, the grip portion 312 may include a strip of grip tape or a ridged surface that embeds into the hand for providing an enhanced grip. Other forms that the grip portion 312 may take may include, without limitation, an adhesive, a strap, and a plurality of spikes. In this manner, the hand can securely grasp and pull back on the firearm slide member 310 for manipulating the firearm 300, including, without limitation, recocking, cleaning, and reloading the firearm. Those skilled in the art, in light of the present teachings, will recognize that the firearm 300 may require cleaning and maintenance with oils and lubricants. These compositions may cause the hand to slip from engagement with the firearm slide member 310. The grip portion 312 positioning on the firearm slide member 310 helps the hand enhance the manipulation of the firearm slide member 310, even under the wet or oily conditions.

Figure 4:
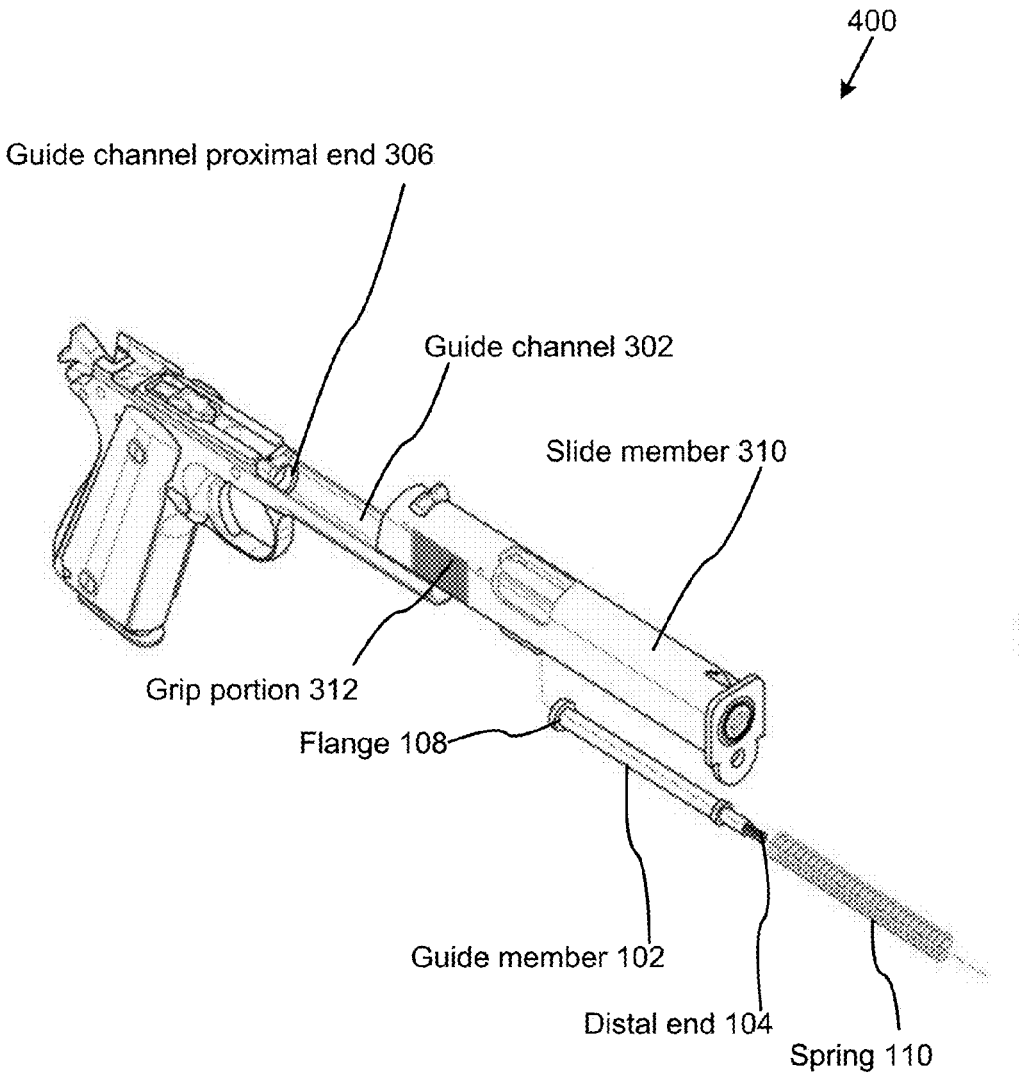
FIG. 4 is a detailed perspective view illustrating an exemplary guide apparatus positioned outside an exemplary firearm, and an exemplary firearm slide member extended for loading the guide member, in accordance with the present invention.

FIG. 4 is a detailed perspective view illustrating an exemplary guide apparatus 100 positioned outside an exemplary firearm 300, and an exemplary firearm slide member 310 extended for loading the guide member 102, in accordance with the present invention. In the present invention, the apparatus 100 is efficacious in guiding the firearm 300 during discharge. The guide member 102 and the grip portion 312 may work in conjunction to further enhance control of the firearm 300. In one alternative embodiment, a laser light may emit from the guide channel distal end 304 for enhancing visual aiming of the firearm 300. Those skilled in the art, in light of the present teachings, will recognize that the resistance that opposes the firearm slide member 310 during discharge may be increased by increasing the length or the stiffness of the spring 110. This is expressed in Hooke's law: $F=kX$, where F is the force needed to extend or compress a theoretical string; k is a stiffness constant, and X is the distance the theoretical spring extends or compresses.

In various embodiments of the present invention, the length of the guide member 102 (i.e. guide rod 102) is adjustable. In various embodiments, the guide rod 102 is telescopic, comprising a cylindrical member within an outer sleeve. In various embodiments, the cylindrical member is threaded into the outer sleeve and extended and retracts by axially rotating the cylindrical member. In the shown embodiment, the cylindrical member comprises the distal end 104 and distends forward of the firearm.

Figures 5A, 5B:
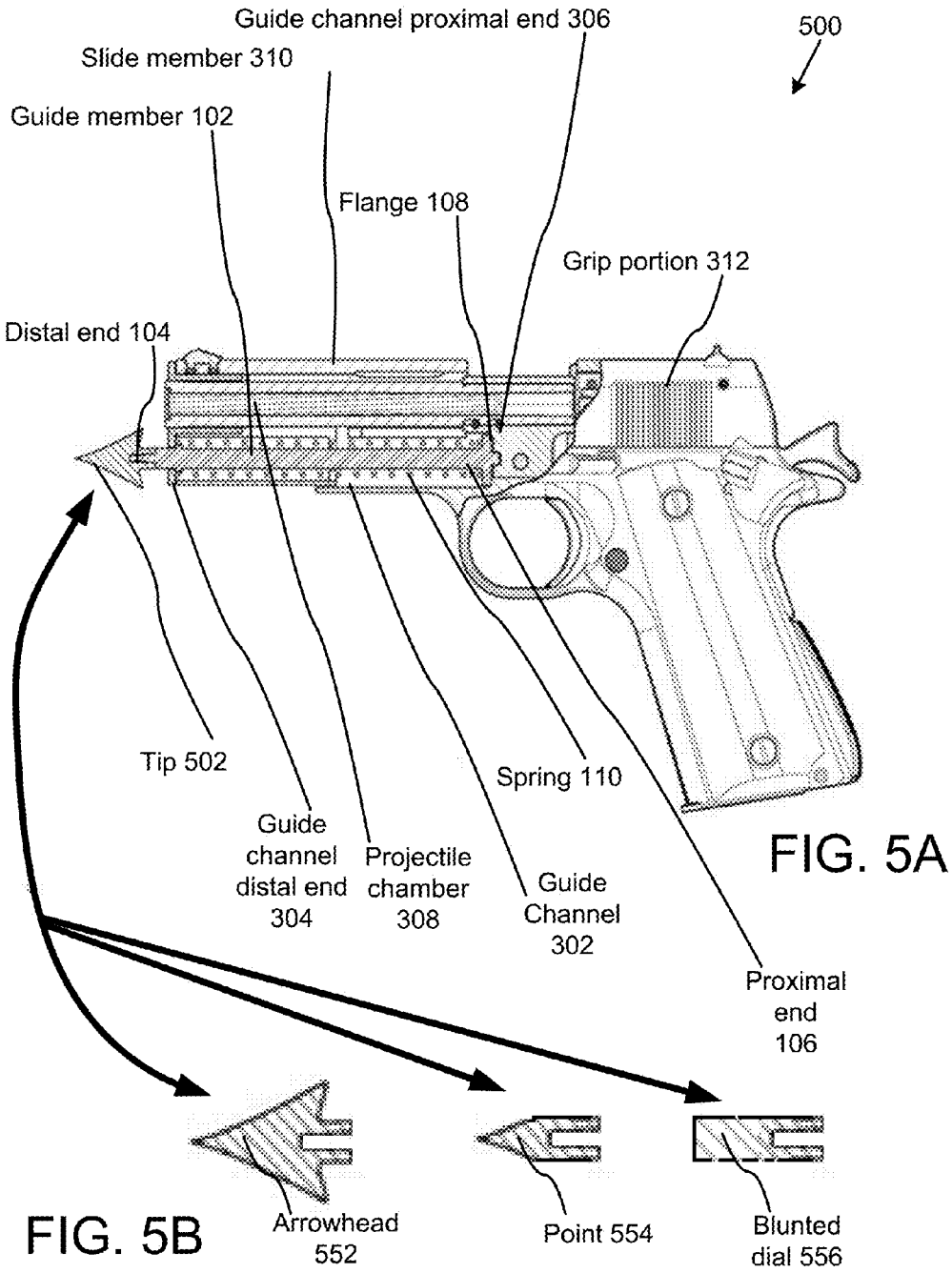
FIG. 5A is a sectioned view, the section taken along section 5-5 of FIG. 3, illustrating an exemplary firearm with an exemplary guide apparatus applying a forward tension on an exemplary firearm slide member, in accordance with the present invention.
FIG. 5B is a sectioned view of three interchangeable tips in accordance with the present invention.

FIG. 5A is a sectioned view, the section taken along section 5-5 of FIG. 3, illustrating an exemplary firearm 300 with an exemplary guide apparatus 100 applying a forward tension on an exemplary firearm slide member 310, in accordance with the present invention. In the present invention, the guide member 102 may be integrally fabricated into the firearm guide channel 302. However, in another embodiment, the guide member 102 may be an interchangeable from the firearm 300. The guide member 102 may be utilized for a variety of firearms, including, without limitation, automatics, semi-automatics, rifles, pistols, and shotguns. The length and diameter of the guide member 102 is adjustable.

A tip 502 comprises one or blades and/or conical, sharpened point may be threaded or otherwise detachably affixed to the distal end 104. In alternative embodiments, a flashlight, laser, and/or counterweight may be affixed to the distal end 104.

FIG. 5B is a sectioned view of three interchangeable tips 552, 554, 556 in accordance with the present invention.

The tip 502 is interchangeable at the distal end 104 of the guide member 102. The tip 502 may comprise, in various embodiments, a blade or arrowhead 552, a pointed- on conical-shaped pint 554, or a blunted tip 556 which may serve as a dial which may have texture, depressions or protrusions for improving grip.

Figure 6:
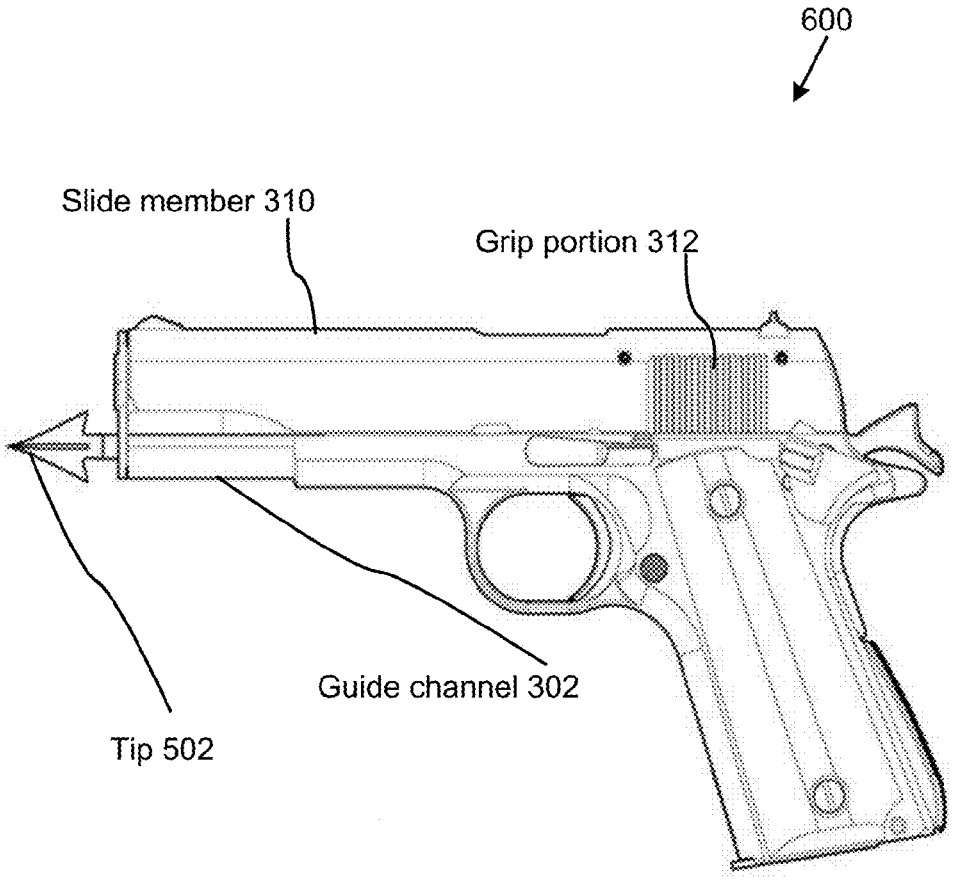
FIG. 6 is a detailed perspective view illustrating an exemplary firearm with an exemplary guide apparatus applying a forward tension on an exemplary firearm slide member, in accordance with the present invention.

FIG. 6 is a detailed perspective view illustrating an exemplary firearm 300 with an exemplary guide apparatus 100 applying a forward tension on an exemplary firearm slide member 310, in accordance with the present invention. In the present invention, the distal end 104 and/or tip 502 may serve as a counterbalance against the recoil. In this manner, a firearm muzzle may be more easily oriented in a downward direction for further enhancing control and guidance. In yet another embodiment, the distal end 104 may join with a tip member 502 having a line site on it for aiming. The tip member line site may extend beyond a line site that is integrated on the barrel of the firearm 300. Those skilled in the art will recognize that extending the aiming site away from the firearm 300 enhances aiming accuracy.

In one embodiment of the present invention, the guide apparatus 100 is designed to help control a firearm 300 through a guide member 102 that extends from the firearm 300 and a spring 110 created tensions that helps minimize lateral movement of the firearm slide member 310 during discharge. A grip portion 312 also allows for enhanced grip on the firearm slide member 310 during manipulation. Details of the installation and use of the guide apparatus 100 are illustrated in FIGS. 7 through 10. In operation, an elongate guide member 102 is oriented with a proximal end 106 pointed towards a rear end of the firearm 300, and a distal end 104 pointed towards a front end of the firearm 300.

The proximal end 106 includes a flange 108. The flange 108 is configured to abut against a guide channel proximal end 306 of the firearm guide channel 302. The distal end 104 includes a threaded end configured to protrude from a guide channel distal end 304 and threadably engage a tip member. A spring 110 comprises a central channel 112 configured to allow the guide member 102 to pass through. The spring 110 may either slide freely along a longitudinal axis of the guide member 102, or lock into a set position along the longitudinal axis of the guide member 102. The position of the spring 110 in relation to the guide member 102 is rotatably adjusted. The spring 110 comprises a spring constant 502 that creates tension upon compression or extension of the spring 110. Due to the position of the spring 110 in relation to the firearm slide member 310, the tension transfers to the firearm slide member 310 to create resistance against the sliding movement. The spring constant 502 is adjusted by rotating the spring 110 in relation to the guide member 102, utilizing different material construct, or a forming a wider or narrower helix along the spring 110.

The configuration of the firearm 300 provides housing for the guide apparatus 100. In one embodiment comprising a semi-automatic firearm, the firearm guide channel 302 positions adjacent to a firearm projectile chamber 308 and a firearm slide member 310. The firearm slide member 310 slides to a forward position of the firearm 300, thereby exposing the firearm guide channel 302. A grip portion 312 is grasped while sliding the firearm slide member 310. In this manner, the guide apparatus 100 may at least partially position inside the firearm guide channel 302. The guide apparatus 100 is disposed to position inside the firearm guide channel 302 with a distal end 104 extending from an aperture in the guide channel distal end 304, and a proximal end 106 abutting against a guide channel proximal end 306. The proximal end 106 comprises a flange 108 that provides a secure engagement with the guide channel proximal end 306. From within the firearm guide channel 302, the spring 110 engages and potentially transfers tension to the firearm slide member 310.

The firearm slide member 310 is then pulled back towards the rear of the firearm 300 in preparation for discharge. During discharge of the firearm 300, the firearm slide member 310 meets resistance from the spring 110, and thereby exhibits less lateral movement in relation to the firearm 300. The restricted lateral movement serves to amplify the velocity of the projectile, and also minimize recoil by the firearm 300. These functions improve accuracy during aiming and discharge. In some embodiments, the distal end 104 of the guide member 102 protrudes from the firearm 300 to provide a rigid extension. The distal end 104 may also join with a tip member, thereby potentially providing an additional weapon to the firearm 300. In this manner, the guide member 102 may be utilized as a counterbalance to the discharge and a weapon or tool to stab an object 1000.

Figure 7A:
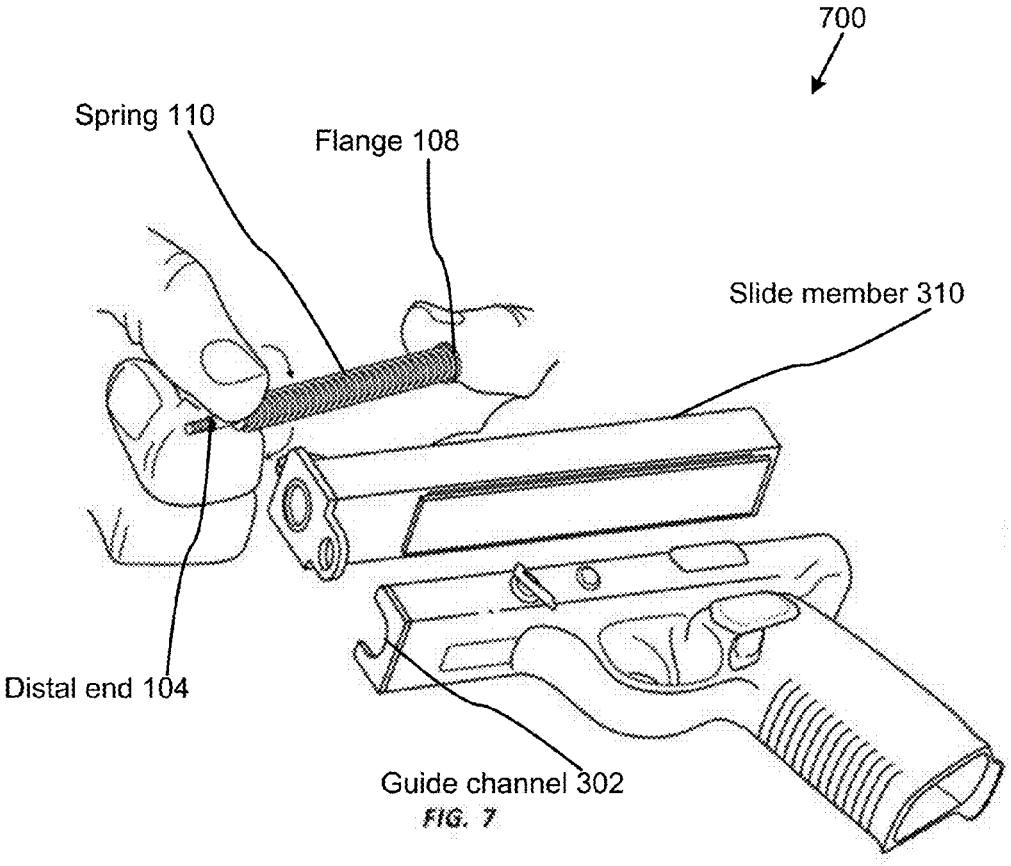
FIG. 7A is a detailed perspective view illustrating an exemplary spring being rotatably adjusted prior to positioning inside an exemplary firearm, in accordance with the present invention.
Figure 7B:
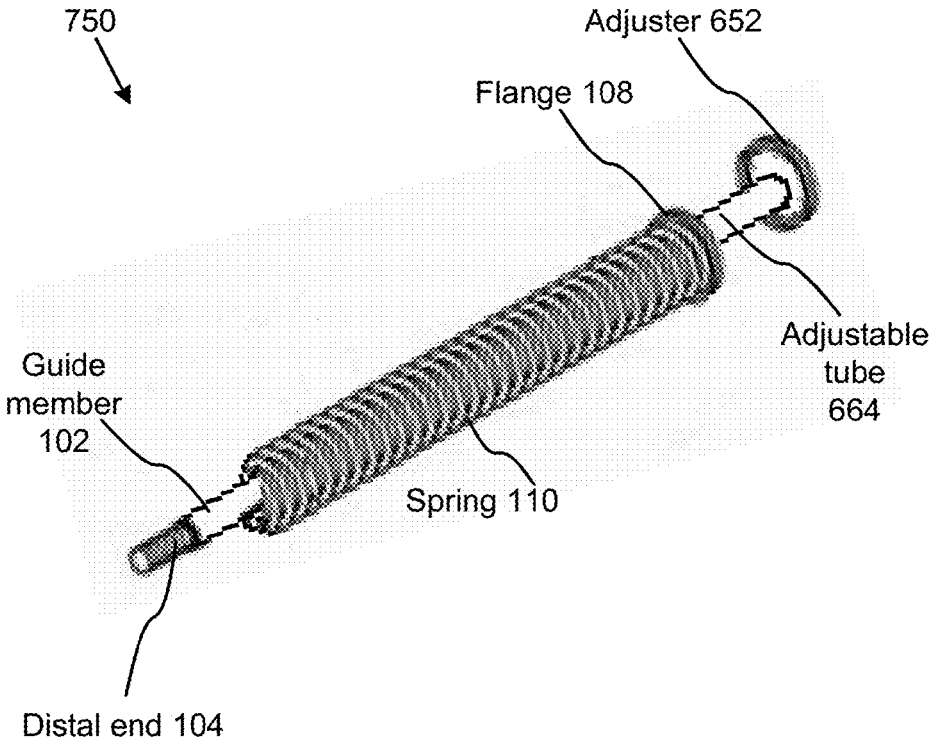
FIG. 7B is a detailed perspective view illustrating one embodiment of a guide member assembly 750.
Figure 8:
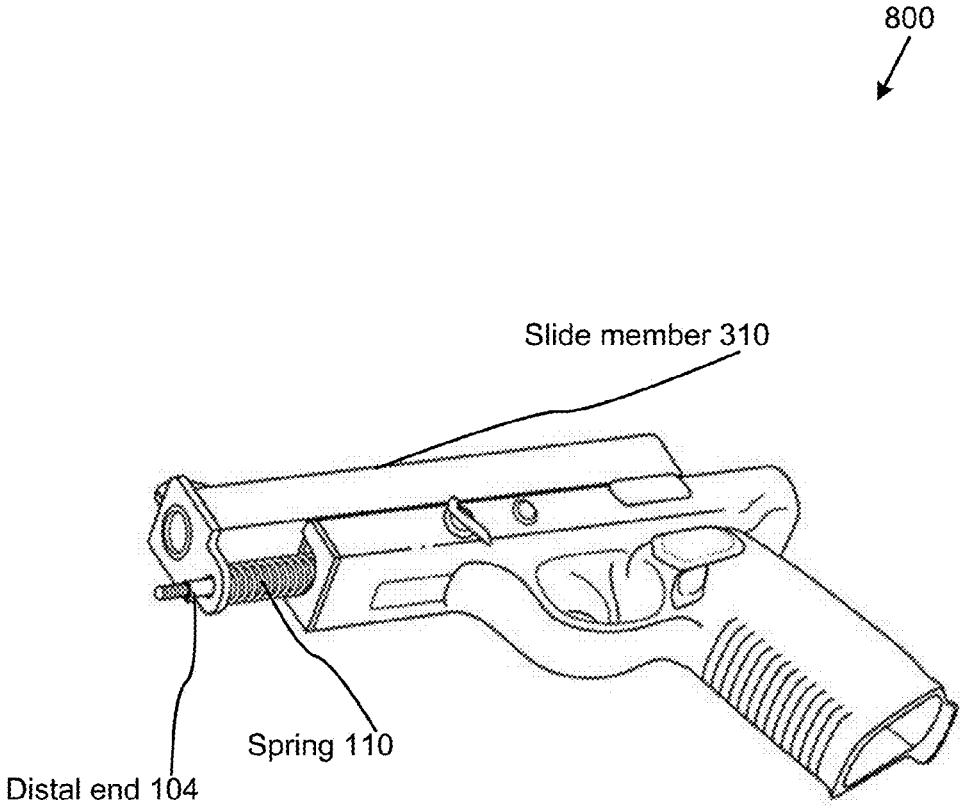
FIG. 8 is a detailed perspective view illustrating an exemplary guide member positioned inside an exemplary firearm with an exemplary firearm slide member extended, in accordance with the present invention.
Figure 9:
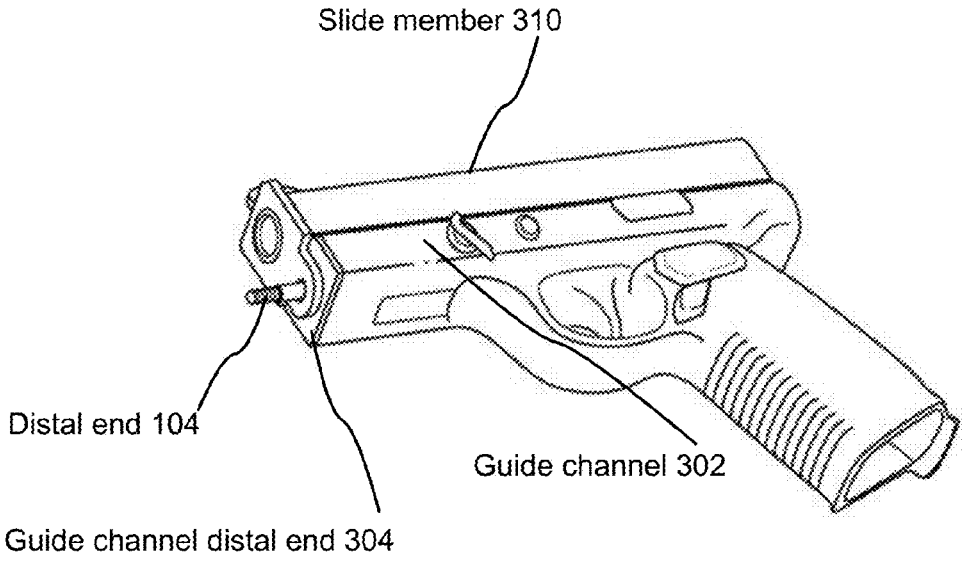
FIG. 9 is a detailed perspective view illustrating an exemplary guide member positioned inside an exemplary firearm with an exemplary firearm slide member extended, in accordance with the present invention.
Figure 10:
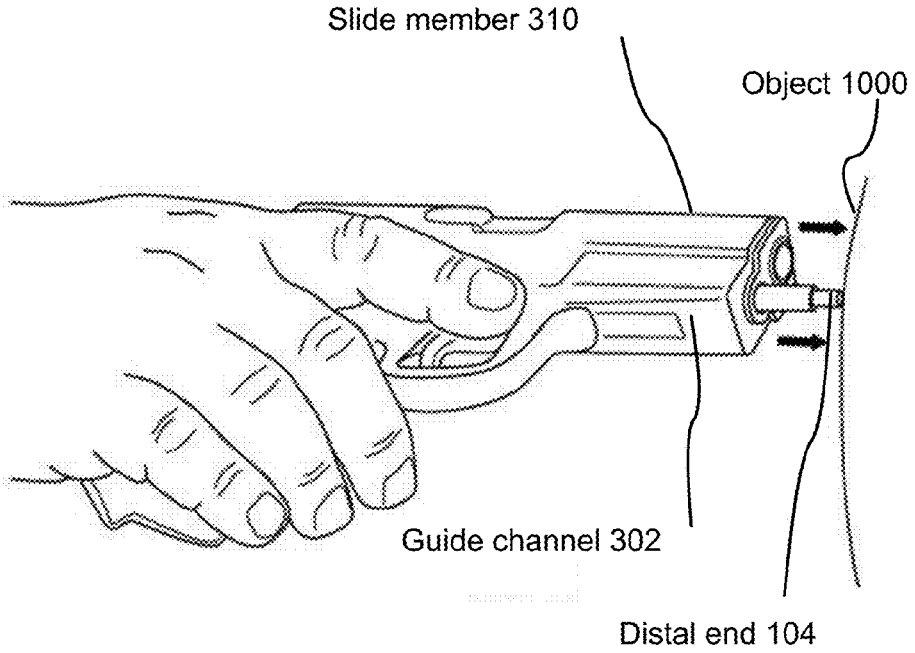
FIG. 10 is a detailed perspective view illustrating an exemplary guide member engaged with an exemplary object, in accordance with the present invention.

FIG. 7B is a detailed perspective view illustrating one embodiment of a guide member assembly 750.

In the shown embodiment, the guide member 102 is hollow, defining a cylindrical interior recess which is threaded interiorly (either clockwise or counterclockwise). The adjuster 652 comprises a disc member similar to the flange 108 which is permanently affixed to a solid, threaded adjustable tube 664. The adjustable tube is threaded into the guide member 102, which guide member 102 acts as a sleeve. In alternative embodiments, the adjustable tube 654 is threaded over the guide member 102, in which embodiment the adjustable tube 654 is hollow acting as a sleeve.

By turning the adjuster 652 axially, or the guide member 102 axially, the distance between the flange 108 and the distal end 104 is reduced. Consequently, the tensile force on the spring 110 is reduced or increased, allowing an adjustment to the resistance on a slide member 310 after bullet discharge.

In various embodiments, the adjuster 652 is fixed in place within a gun such that the adjuster 652 cannot rotate axially within the gun. This may be accomplished by changing the shape of the adjuster 652 from its shown disc-shaped to one that is square, triangular, or otherwise-shaped with flat edges abutting corresponding interior edging within the gun.

All threaded components of the present invention may be reverse-threaded in various embodiments.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An adjustable guide rod assembly for adjusting a tensile force on a spring internal to a pistol, the guide rod assembly comprising:

an elongated guide member, the guide member being disposed to at least partially pass through a firearm guide channel, the guide member comprising a proximal end, the proximal end being disposed to abut against a guide channel proximal end, the guide member further comprising a distal end, the distal end being disposed to at least partially protrude from a guide channel distal end, the guide member further comprising a disc-shaped flange;

a spring, the spring comprising a central channel with a portion of the guide member passing through, the spring disposed in a lateral-restraining relationship with the guide member, the spring abutting the flange, wherein the distal end is turnable by hand to adjust a distance between the distal end and the flange thus altering a length of the spring and the tensile force on the spring;

wherein the spring is operable to transfer a tension to a firearm slide member, the tension being operable to help minimize lateral movement of the firearm slide member, wherein rotatable engaging the guide member with the spring adjusts a length that the distal end distends forward of the guide channel;

wherein a recoil of the firearm during discharge of a projectile is at least partially minimized; and wherein a velocity of a projectile discharged from a firearm projectile chamber is increased with alteration of the length of the spring.

2. The apparatus of claim 1, wherein the pistol comprises a semi-automatic firearm having a closed-bolt firing mechanism.

3. The apparatus of claim 1, wherein the firearm guide channel is disposed to position adjacent to the firearm projectile chamber and the firearm slide member.

4. The apparatus of claim 1, wherein the guide member and the spring slidably move relative to each other in the firearm guide channel.

5. The apparatus of claim 1, wherein the guide member and the spring secure in a locked position relative to each other in the firearm guide channel.

6. The apparatus of claim 1, wherein rotatably engaging the guide member with the spring adjusts the spring constant.

7. The apparatus of claim 1, wherein rotatably engaging the guide member with the spring adjusts a length that the distal end distends forward of the guide channel.

8. The apparatus of claim 1, wherein the proximal end comprises a flange axially circumscribing the proximal end.

9. The apparatus of claim 1, wherein the guide member comprises a polymer.

10. An adjustable guide rod assembly for adjusting a tensile force on a spring internal to a pistol, the guide rod assembly comprising:

an elongated guide member, the guide member being disposed to at least partially pass through a firearm guide channel, the guide member comprising a proximal end, the proximal end being disposed to abut against a guide channel proximal end, the guide member further comprising a distal end, the distal end being disposed to at least partially protrude from a guide channel distal end, the guide member further comprising a disc-shaped flange;

a spring, the spring comprising a central channel with a portion of the guide member passing through, the spring disposed in a lateral-restraining relationship with the guide member, the spring abutting the flange, wherein the distal end is turnable by hand to adjust a distance between the distal end and the flange thus altering a length of the spring and the tensile force on the spring;

wherein the spring is operable to transfer a tension to a firearm slide member, the tension being operable to help minimize lateral movement of the firearm slide member, wherein a recoil of the firearm during discharge of a projectile is at least partially minimized; and wherein a velocity of a projectile discharged from a firearm projectile chamber is increased with alteration of the length of the spring;

wherein the distal end comprises a threading for threadably engaging a tip member, the tip member comprising one of a sharp, conical point and one or more sharpened blades.

* * * * *